US008800364B2

(12) United States Patent
Farano et al.

(10) Patent No.: US 8,800,364 B2
(45) Date of Patent: Aug. 12, 2014

(54) DEVICE FOR DETECTING THE LIQUID LEVEL IN THE WASHING BATH OF A WASHING MACHINE

(75) Inventors: Michele Farano, Turin (IT); Marco Marozzo, Pianezza (IT)

(73) Assignee: Elbi International S.p.A., Turin (IT)

( * ) Notice: Subject to any disclaimer, the term of this patent is extended or adjusted under 35 U.S.C. 154(b) by 250 days.

(21) Appl. No.: 13/126,402

(22) PCT Filed: Oct. 26, 2009

(86) PCT No.: PCT/IB2009/054722

§ 371 (c)(1),
(2), (4) Date: Apr. 27, 2011

(87) PCT Pub. No.: WO2010/049873

PCT Pub. Date: May 6, 2010

(65) Prior Publication Data

US 2011/0203365 A1 Aug. 25, 2011

(30) Foreign Application Priority Data

Oct. 28, 2008 (IT) ..... TO2008A0796

(51) Int. Cl.
*G01F 23/26* (2006.01)
*A47L 15/42* (2006.01)
*D06F 39/08* (2006.01)

(52) U.S. Cl.
CPC ..... *D06F 39/087* (2013.01); *A47L 15/4244* (2013.01)
USPC ..... 73/290 R; 200/83 WM

(58) Field of Classification Search
USPC ..... 73/298, 299, 301; 116/109; 340/614, 340/618, 626; 200/83 WM
See application file for complete search history.

(56) References Cited

U.S. PATENT DOCUMENTS 2,609,662 A * 9/1952 Nims et al. ..... 60/39.281
2,629,458 A * 2/1953 Allen et al. ..... 96/409
3,010,304 A * 11/1961 Altorfer ..... 68/23.4
3,064,094 A * 11/1962 Marchi ..... 200/83 WM (Continued)

FOREIGN PATENT DOCUMENTS

DE 198 35 865 A1 2/1999
DE 10 2006 020 151 A1 11/2006
EP 1 726 702 A1 11/2006
FR 2 514 526 A1 4/1983

*Primary Examiner* — Hezron E Williams
*Assistant Examiner* — Mark A Shabman
(74) *Attorney, Agent, or Firm* — Sughrue Mion, PLLC

(57) ABSTRACT

The device (1) comprises a body (2) in which are formed a first and second chamber (14, 15) separated sealingly from each other by a resilient diaphragm (6). The first chamber (14) has an inlet opening (2*c*) intended to be put in pneumatic communication with the region of a container which is above the liquid; the second chamber (15) communicates with the atmosphere. A winding (8) is mounted in a fixed position in the body (2), on the side opposite the first chamber (14) with respect to the diaphragm (6). A core (11) is coupled to the diaphragm (6) and is movable with respect to the winding (8) such that in operation the inductance of the winding (8) varies as a function of the position of the core.
The device also comprises a first spring (12) tending to move the core (11) towards the diaphragm (6), and a second spring (16) tending to oppose the action of the first spring (12). The second spring (16) is positioned in the second chamber (15).

2 Claims, 6 Drawing Sheets

(56) References Cited

U.S. PATENT DOCUMENTS

| | | | | |
|---|---|---|---|---|
| 3,334,651 | A * | 8/1967 | Clearman | 137/390 |
| 3,487,684 | A * | 1/1970 | Chadwick | 73/170.21 |
| 3,917,218 | A * | 11/1975 | Marocco | 251/30.03 |
| 4,081,636 | A * | 3/1978 | Rice | 200/83 Y |
| 5,187,338 | A * | 2/1993 | Kaigler | 200/83 R |
| 5,245,869 | A * | 9/1993 | Clarke et al. | 73/149 |
| 5,403,198 | A * | 4/1995 | Koganemaru et al. | 439/333 |
| 6,539,806 | B2 * | 4/2003 | Wright | 73/703 |
| 6,628,396 | B1 * | 9/2003 | Gul | 356/437 |
| 7,180,285 | B2 * | 2/2007 | Bindocci et al. | 324/207.15 |
| 7,449,647 | B2 * | 11/2008 | Kranjc | 200/83 WM |
| 7,592,726 | B2 * | 9/2009 | Heyder | 310/90 |
| 2004/0211228 | A1 | 10/2004 | Nishio et al. | |
| 2005/0140359 | A1 * | 6/2005 | Bindocci et al. | 324/207.15 |
| 2006/0283211 | A1 * | 12/2006 | Bindocci et al. | 68/12.05 |
| 2008/0047821 | A1 * | 2/2008 | Pearson et al. | 200/83 WM |
| 2009/0266144 | A1 * | 10/2009 | Rezachek | 73/24.02 |
| 2010/0116957 | A1 * | 5/2010 | Bauer et al. | 248/222.14 |
| 2010/0249570 | A1 * | 9/2010 | Carson et al. | 600/407 |
| 2011/0247488 | A1 * | 10/2011 | Oikawa | 92/144 |

* cited by examiner

DEVICE FOR DETECTING THE LIQUID LEVEL IN THE WASHING BATH OF A WASHING MACHINE

CROSS REFERENCE TO RELATED APPLICATION

This application is a National Stage of International Application No. PCT/IB2009/054722 filed Oct. 26, 2009, claiming priority based on Italian Patent Application No. TO2008A000796, filed Oct. 28, 2008, the contents of all of which are incorporated herein by reference in their entirety.

The present invention relates to a device for detecting the level of a liquid in a container, particularly a device for detecting the level of the washing bath in a washing machine such as a laundry washing machine or a dishwasher.

More specifically, the invention relates to a detector device comprising:

- a hollow body wherein there is defined an inner region which is divided into first and second chambers which are sealingly separated from one another by a resilient diaphragm, the first chamber having an inlet opening intended to be put in pneumatic communication with the region of the container located above said liquid, the second chamber communicating with the atmosphere;
- a winding mounted in a fixed position in the body, on the side opposite the first chamber with respect to the diaphragm;
- a core coupled to the diaphragm and movable with respect to the winding such that in operation the inductance of the winding varies as a function of the position of said core; and
- first resilient means tending to move the core towards the diaphragm and second resilient means tending to oppose the action of the first resilient means.

A known device of this type for laundry washing machines is located outside the washing bath with the opening of the aforesaid first chamber connected through a pipe, which is generally flexible, to an "air trap" mounted in the washing bath in the vicinity of the level of the washing bath which is to be detected. The "air trap" can be simply a kind of cup in an inverted position with a top opening connected to the level detector device through the aforesaid flexible pipe.

The known solution described above has a number of drawbacks. In the first place, it requires the use of the detector device and the air trap and their interconnection by means of a flexible pipe, typically using hose clamps.

One object of the present invention is to provide an improved device for detecting the level of a liquid in a container by means of which the level of the liquid can be detected directly, without using an "air trap" and without connecting pipes.

This and other objects are achieved according to the invention with a detector device of the type defined above, the principal feature of which resides essentially in the fact that the aforesaid resilient means are located in the aforesaid second chamber.

The detector device according to the invention can be mounted directly in the washing bath of a washing machine, in such a way that the inlet opening or mouth of its aforesaid first chamber faces the liquid (the washing bath) in operation, and can be closed by the liquid when the level of the latter rises above a predetermined level, such that the first chamber then acts as an air trap.

The aforesaid second resilient means, which can be made, for example, in the form of a spiral spring, are protected from direct contact with the washing bath and from any foreign bodies contained therein, such as lint or other residues.

Further features and advantages of the invention will be made clear by the following detailed description, provided purely by way of non-limiting example, with reference to the appended drawings, in which.

Figure 5:
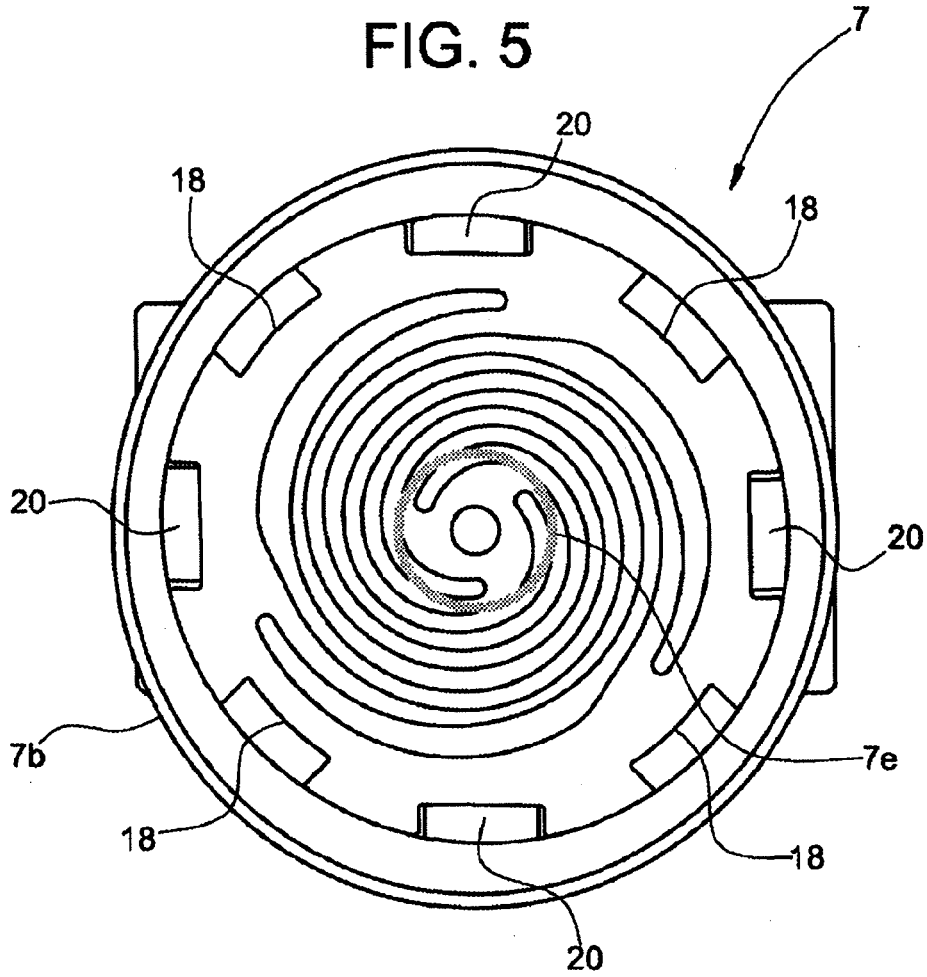
Figure 5A:
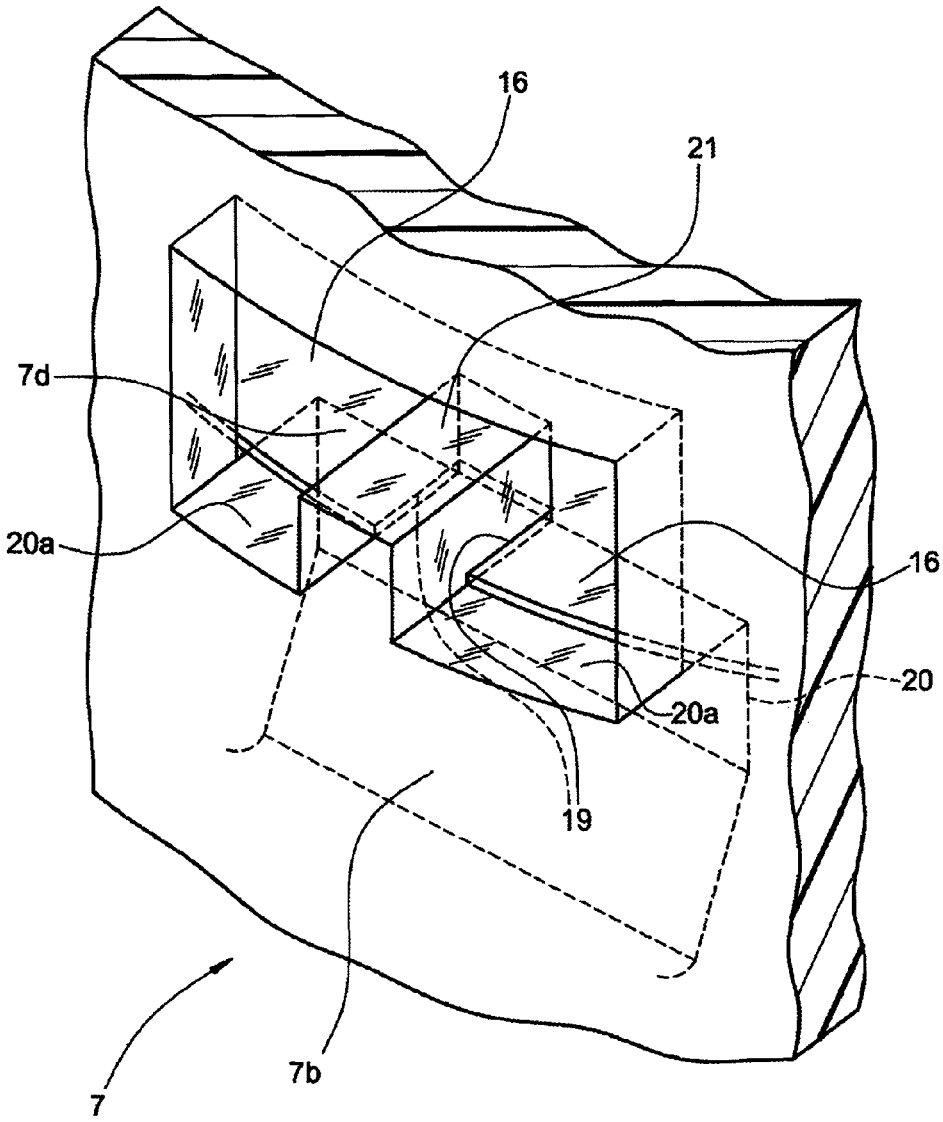

FIG. 5*a* is a partial perspective view of the spool member; and

Figure 3:
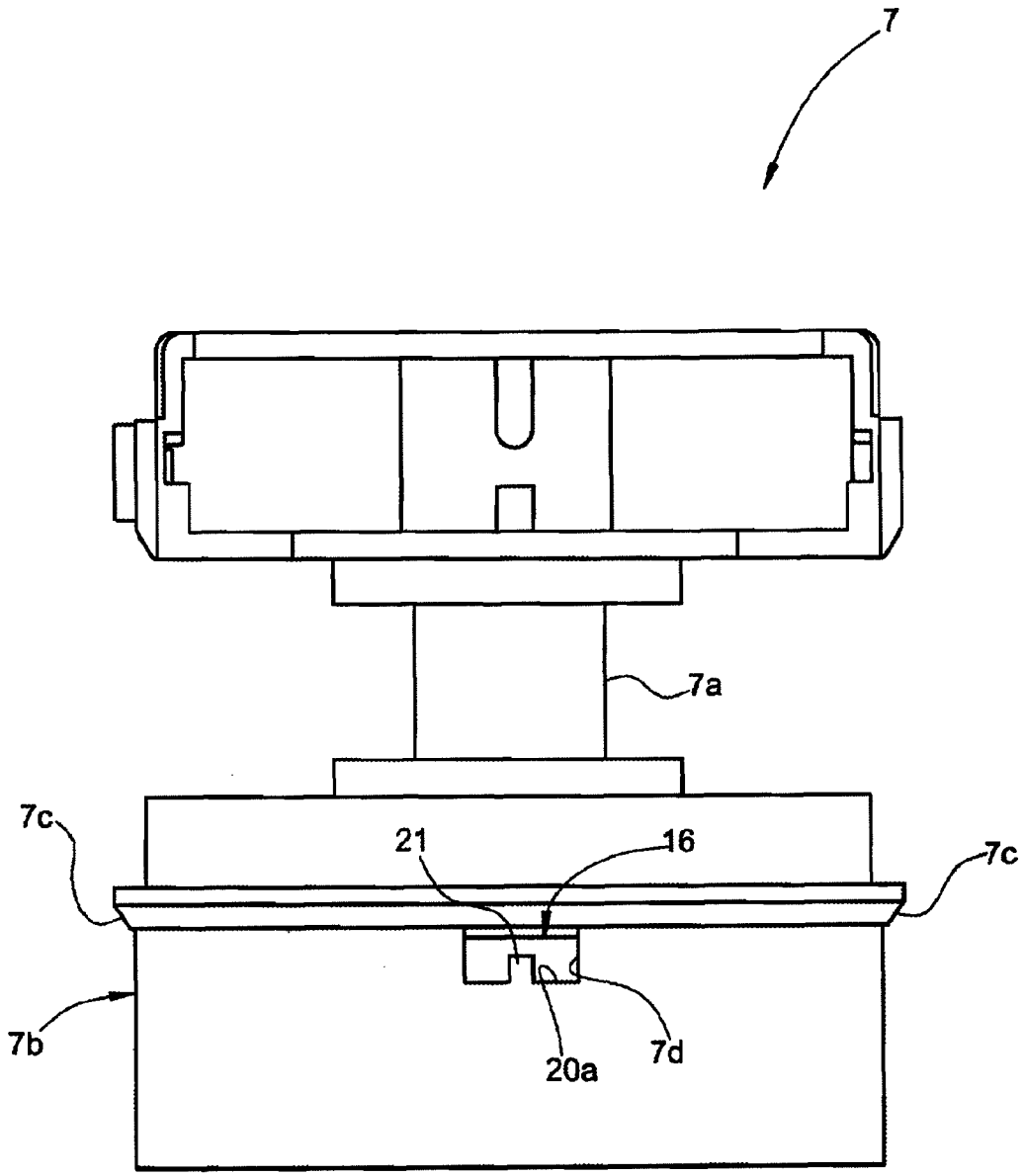
FIG. 3 is a view in elevation of a spool member included in the device according to FIG. 1.
Figure 4:
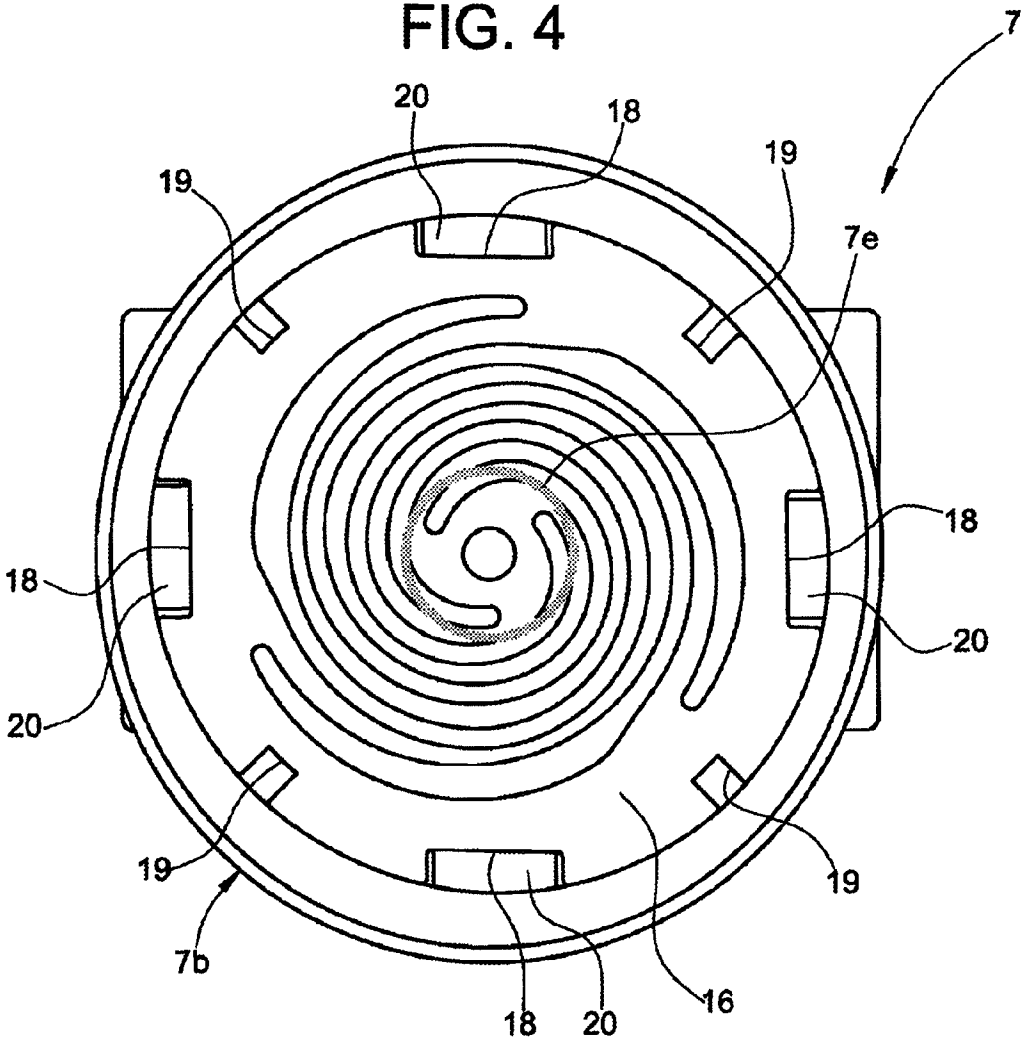
FIGS. 4 and 5 are sectional views, essentially taken through the line IV-IV (V-V) of FIG. 1, in a first and second stage, respectively, of the mounting of the spiral spring in the spool member.
Figure 6:
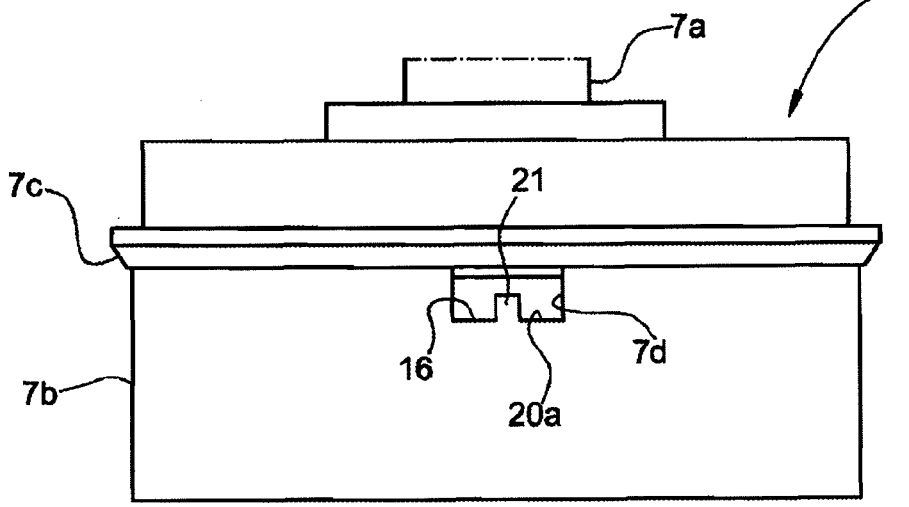

FIG. 6 is a partial view in elevation similar to that shown in FIG. 3, and corresponds to the stage of mounting of the spring shown in FIG. 5.

Figure 1:
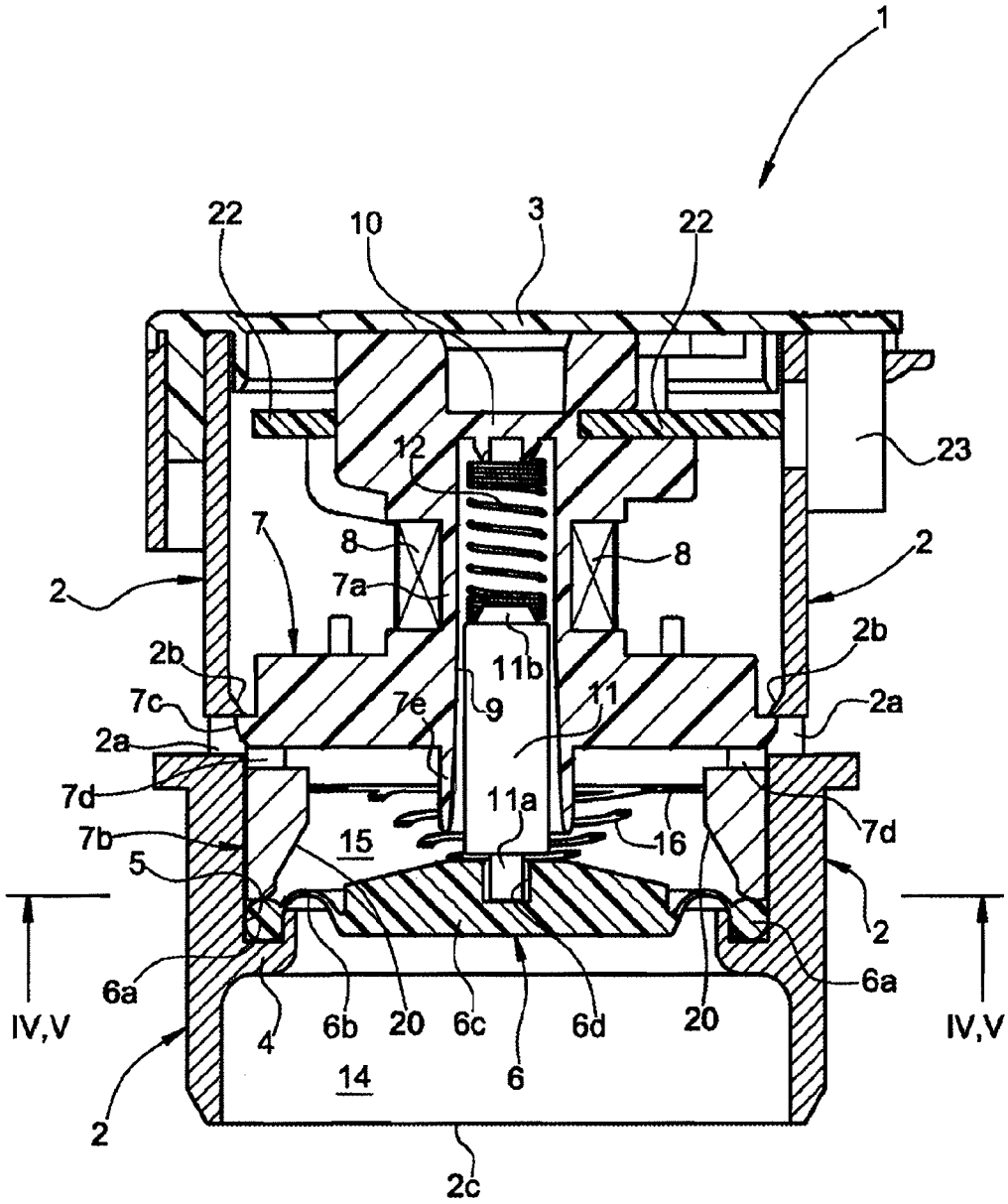
FIG. 1 is a view in axial section of a device for detecting the level of a liquid according to the present invention.

In FIG. 1, the number 1 indicates the whole of a device according to the invention for detecting the level of a liquid in a container, particularly for detecting the level of the washing bath in a washing machine.

In the embodiment illustrated by way of example, the device 1 comprises an essentially cylindrical tubular body 2, made for example from moulded plastic material.

The body 2 is closed at its top by a cover 3, which is preferably removable.

In its lower part, the body 2 is provided internally with a collar-like annular formation 4, which has an essentially L-shaped cross section. An annular channel 5, open at its top, is formed between the essentially vertical branch of this formation and the wall of the body 2.

The number 6 indicates a diaphragm, made for example from elastomeric material.

This diaphragm has a peripheral ring 6*a*, fitted in the channel 5 of the body 2. The ring 6*a* is joined to an intermediate annular portion 6*b* of the diaphragm 6, which is highly flexible, and which is joined in turn to a central portion 6*c* of said diaphragm, which is essentially thicker and therefore relatively more rigid. A recess or indentation 6*d* is formed in the central part of the upper surface or face of the diaphragm 6.

The number 7 in FIG. 1 indicates the whole of a member shaped in the form of a spool. This member 7 is made, for example, from moulded plastic material, and has an intermediate portion 7*a* of reduced diameter, around which a winding 8 of insulated electrical wire is wound.

The member 7 has a lower portion 7*b*, which is essentially bell-shaped and has a larger diameter. This bell-shaped portion 7*b* has a circumferential projection 7*c*, beveled or rounded towards its lower part and towards the axis.

Immediately below this projection, the portion 7*b* of the spool member 7 has a plurality of essentially radial through holes 7*d*.

The member 7 is inserted into the body 2 through the upper end of the latter, and is therefore mounted in the position shown in FIG. 1, in which its lower end retains the peripheral ring 6*a* of the diaphragm 6 in the annular seat 5 of the body 2.

In the assembled condition shown in FIG. 1, portions remote from the rounded projection 7*c* are engaged by snap-fitting with corresponding radial holes 2*a* in the body 2, immediately beyond corresponding inner projections 2*b* of the body.

The holes 2*a* in the body 2 communicate at least partially with the holes 7*d* of the spool member 7, for reasons which are explained below.

The spool member 7 is axially traversed by a passage 9 which is open below and which is closed at its top by a transverse partition 10 integral with the member 7. This passage 9 extends downwards to the end of a tubular appendage 7*e* of the member 7, which extends downwards to a certain distance from the diaphragm 6.

The number 11 indicates a movable core, made from ferromagnetic material for example, mounted in the passage 9 of the body 7.

In the illustrated embodiment, the core 11 has a lower shank 11*a* engaged in the central indentation or recess 6*d* of the diaphragm 6, and a tapered upper protuberance 11*b*.

A helical spring 12 is positioned in the passage 9 of the member 7, between the upper end of the core 11 and the partition 10. This spring tends to push the core 11 towards the diaphragm 6.

The diaphragm 6 divides the inner region enclosed by the body 2 and by the lower portion 7*b* of the spool member 7 into two chambers 14 and 15 which are sealingly separated from each other.

The chamber 14 opens downwards at the position of the wide mouth 2*c* of the lower end of the tubular body 2.

The chamber 15 is in permanent communication with the atmosphere surrounding the device 1, via the holes 7*d* of the spool member 7 and the holes 2*a* of the body 2.

The number 16 indicates a further spring which is of the spiral type in the illustrated embodiment. This spring is positioned in the chamber 15, and is therefore located between the diaphragm 6 and the spool member 7, and in particular it surrounds the tubular appendage 7*e* of the latter.

Figure 2:
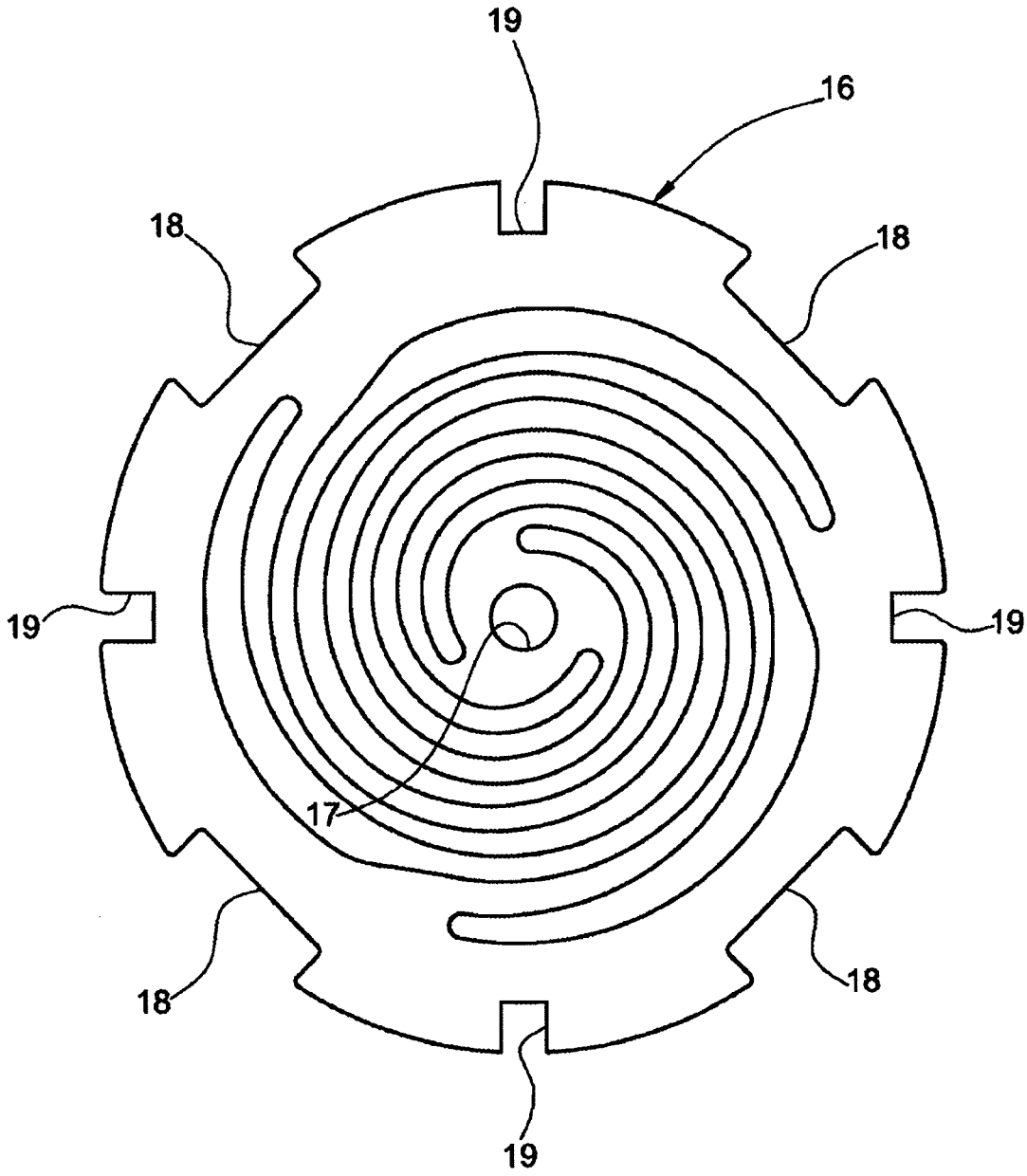
FIG. 2 is a plan view of a spiral spring included in the device according to FIG. 1.

At rest, the spring 16 is essentially flat, as shown in FIG. 2. It has a central hole 17 (FIG. 2) through which the lower shank 11*a* of the core 11 extends (FIG. 1).

The arrangement is such that the spring 12 pushes the core 11 downwards, in such a way that the lower end of the core deforms the flat spring 16, making it assume the configuration shown in FIG. 1.

The periphery of the spring 16 is fastened to the lower portion 7*b* of the spool member 7 as described below.

With reference to FIG. 2, in the illustrated embodiment the spring 16 has an indented peripheral edge, with four cut-outs 18 spaced at equal angular intervals, alternating with cut-outs 19 which are also equally spaced but have smaller angular extensions.

As shown in FIGS. 1, 4, 5 and 5*a*, the inner surface of the lower shell 7*b* of the spool member 7 has four protuberances 20, spaced at equal angular intervals, each next to a hole 7*d* of this member.

The protuberances 20 have cross sections which are essentially complementary to those of the larger cut-outs 18 of the spiral spring 16.

As shown more fully in FIGS. 3, 5*a* and 6, each protuberance 20 terminates at its top in a flat surface 20*a*, next to the associated hole 7*d*. A corresponding projection 21 extends centrally from this flat surface 20*a*, the height of this projection being less than that of the hole 7*d*. The projection extends in an essentially radial direction, and its radially inner portion has a profile, in plan view, essentially complementary to that of the smaller cut-outs 19 of the spiral spring 16.

Accordingly, the fitting of the spring 16 into the lower portion 7*b* of the spool member takes place essentially in the following manner.

The spring 16 is inserted through the lower hole of said portion 7*b* of the spool member 7, with the larger cut-outs 18 sliding in a guided way along the corresponding protuberances 20. The translation of the spring 16 continues until its periphery is carried beyond the top of the projections 21 of the holes 7*d*, as shown in FIG. 3. In this condition, the spring 16 is rotated through 45°, until its smaller cut-outs 19 are angularly aligned with the corresponding projections 21 of the spool member. When this alignment has been completed, the spring 16 is allowed to fall back in such a way that its cut-outs 19 and the projections 21 are coupled together so that the assembled condition shown in FIGS. 5*a* and 6 is obtained. In this condition, the peripheral portions of the spring 16 adjacent to the cut-outs 19 bear on the flat surfaces 20*a* located on the tops of the protuberances 20, as shown for example in FIG. 5*a*.

The procedure for coupling and mounting the spring 16 on the spool member 7 is essentially what is known as a bayonet coupling procedure.

With reference to FIG. 1, the winding or coil 8 is connected to a processing circuit of a known type, conveniently mounted at least partially on a supporting plate 22 mounted in the upper portion of the spool member 7, and connectable to external circuits or devices through a connector 23 formed in the body 2 of the device 1.

The detector device 1 described above is suitable for use in the washing bath of a washing machine, particularly a laundry washing machine, in such a way that its lower opening or mouth 2*c* can be closed by the body of washing liquid contained in this bath when its level rises above a predetermined reference level. In this condition, the chamber 14 of the device 1 acts in exactly the same way as an air trap. The air trapped in the chamber 14 is pressurized by the tendency of the washing bath to rise further. The increase in pneumatic pressure in the chamber 14 causes the upward displacement of the diaphragm 6, and consequently the core 11, with respect to the winding 8. The inductance of this winding varies accordingly, and this variation can be detected, for example in the form of a variation of the frequency of an LC resonant circuit.

The direct exposure of the level detector device 1 to the washing bath is made possible, in particular, by the fact that the spring 16 is housed safely in the chamber 15 which is sealingly separated from the chamber 14 into which said washing liquid or bath can penetrate.

If a loss of sealing between the chambers 14 and 15 occurs after prolonged operation, for example as a result of a tear in the diaphragm 6, any liquid entering the chamber 15 can be removed through the holes 7*d* of the spool member 7 and the corresponding holes 2*a* of the body 2 of the device.

Naturally, the principle of the invention remaining the same, the forms of embodiment and the details of construction may be varied widely with respect to those described and illustrated, which have been given purely by way of non-limiting example, without thereby departing from the scope of the invention as defined by the attached claims.

The invention claimed is:

1. A device (1) for providing a signal indicating the instantaneous level of a liquid in a container, comprising a hollow body (2) wherein there is defined an inner region (14, 15) which is divided into first and second chambers (14, 15) which are sealingly separated from one another by a resilient diaphragm (6), the first chamber (14) having an inlet opening (2*c*) for pneumatic communication with the region which in the container is above said liquid, the second chamber (15) communicating with the atmosphere;

a winding or coil (8) mounted in a fixed position in the body (2), on the side opposite the first chamber (14) with respect to the diaphragm (6);

a core ferromagnetic (11) coupled to the diaphragm (6) and movable with respect to the winding (8) such that in the operation the inductance of the winding (8) varies as a function of the position of said core; and first resilient means (12) tending to move the core (11) towards the diaphragm (6) and second resilient means (16) tending to oppose the action of the first resilient means (12);

said second resilient means (16) being disposed in said second chamber (15), wherein said second resilient means comprise a spiral spring (16) whose peripheral portion is mounted in the body (2) by a coupling which is essentially of the bayonet type, wherein the winding (8) is carried by a spool member (7) mounted in the body (2) and having an hollow lower portion (7*b*) in which there is mounted said spiral spring (16), and wherein the spiral spring (16) has first guiding cut-outs (18) alternated with second coupling cut-outs (19), and said hollow portion (7*b*) of the spool member (7) has a plurality of guiding protuberances (20) adapted to engage with said first cut-outs (18) of the spring (16) to allow the introduction of the spring in the spool member (7) up to a position in which the spring (16) is capable of being rotated such that the coupling cut-outs (19) are aligned and capable of being coupled with corresponding retaining formations (21) of said lower portion (7*b*) of the spool member (7).

2. A container for a liquid, particularly a washing chamber in a washing machine, to which there is associated a device (1) for detecting the level of the liquid according to claim 1, mounted in such a way that the opening or mouth (2*c*) of said first chamber (14) in the operation faces said liquid and is closed by the liquid when the level thereof increases above a predetermined level, said first chamber (14) operating in such a situation as an air trap.

* * * * *